US009224565B2

(12) United States Patent
Moon

(10) Patent No.: US 9,224,565 B2
(45) Date of Patent: Dec. 29, 2015

(54) MANUFACTURING OF AN AUTOMOBILE FUSE

(76) Inventor: Hyungtai Moon, Incheon (KR)

( * ) Notice: Subject to any disclaimer, the term of this patent is extended or adjusted under 35 U.S.C. 154(b) by 867 days.

(21) Appl. No.: 13/504,619

(22) PCT Filed: Nov. 11, 2010

(86) PCT No.: PCT/KR2010/007939

§ 371 (c)(1),
(2), (4) Date: Apr. 27, 2012

(87) PCT Pub. No.: WO2011/059238

PCT Pub. Date: May 19, 2011

(65) Prior Publication Data

US 2012/0223801 A1 Sep. 6, 2012

(30) Foreign Application Priority Data

Nov. 11, 2009 (KR) ..... 10-2009-0108427

(51) Int. Cl.

| | |
|---|---|
| ***H01H 69/02*** | (2006.01) |
| ***H01H 85/30*** | (2006.01) |
| ***H01H 85/041*** | (2006.01) |
| ***H01H 85/17*** | (2006.01) |

(52) U.S. Cl.
CPC ..... *H01H 85/30* (2013.01); *H01H 69/02* (2013.01); *H01H 85/0417* (2013.01); *H01H 85/17* (2013.01); *Y10T 29/49107* (2015.01)

(58) Field of Classification Search
CPC ..... G01K 11/12; B29C 66/91218; Y10T 29/49107; H01H 69/02; H01H 85/17; H01H 85/30
USPC ..... 29/623; 252/408.1
See application file for complete search history.

(56) References Cited

U.S. PATENT DOCUMENTS 7,517,475 B2 * 4/2009 Lucht et al. ..... 252/408.1
7,833,438 B2 * 11/2010 Lucht et al. ..... 252/408.1

FOREIGN PATENT DOCUMENTS

| | | |
|---|---|---|
| JP | 2001076610 | 3/2001 |
| JP | 2003203553 | 7/2003 |
| KR | 1998-026964 | 7/1998 |
| KR | 20020049103 | 6/2002 |
| KR | 20030082838 | 10/2003 |

* cited by examiner

*Primary Examiner* — Thiem Phan
(74) *Attorney, Agent, or Firm* — IPLA P.A.; James E. Bame

(57) ABSTRACT

A method of manufacturing an automobile comprising: mixing 96~99 wt % of colored plastic powder with 1~4 wt % of transparent irreversible thermochromic pigment powder thus preparing a material mixture for a fuse body; melting the material mixture using an injection molding machine so that the fuse body containing a thermochromic pigment component is molded at an injection temperature of 300~310° C. and an injection pressure of 1200~1600 kg f/cm$^2$ using an injection mold; drying the fuse body containing the thermochromic pigment component at 100~200° C. for 3~5 hr; inserting a fuse element comprising a pair of terminal members and a fuse member fixed therebetween into a pair of terminal insertion recesses and a fuse charging recess of the fuse body containing the thermochromic pigment component.

2 Claims, 12 Drawing Sheets

MANUFACTURING OF AN AUTOMOBILE FUSE

BACKGROUND OF THE INVENTION

The present invention relates to a fuse, and, more particularly, to an automobile fuse which changes color when exposed to heat generated instantly upon short-circuiting of a fuse member so that the short-circuited fuse can be easily identified, and to a method of manufacturing the same.

Generally, a fuse box of an automobile includes a great number of fuses.

Thus, whether a specific fuse has short-circuited cannot be easily determined when an electrical short occurs. Particularly, because fuses are recently manufactured to be small, it is not easy to detect the short-circuited fuse, making it difficult to replace such a fuse.

Methods of easily identifying the short-circuited fuse have been devised, and prior art references related thereto include Korean Unexamined Utility-model Publication No. 20-1998-016214 and Korean Unexamined Patent Publication No. 10-1997-0039084.

However, such prior art references need, in addition to the fuse, an additional circuit device which enables a diode (lamp) which is additionally wired to turn on when an electrical short occurs so as to detect or display the short-circuited fuse.

Accordingly, the manufacturing cost becomes very high, and there is concern that the additional circuit device in addition to the fuse may be faulty. Alternatively the case where a fault takes place makes it difficult to easily detect the short-circuited fuse, and thus procedures of separately checking and detecting a great number of fuses and then replacing the detected fuse should be carried out, which is regarded as troublesome.

SUMMARY OF THE INVENTION

Accordingly, an object of the present invention is to provide an automobile fuse the color of which spontaneously changes upon short-circuiting, so that the short-circuited fuse may be easily identified with the naked eye.

Another object of the present invention is to provide an automobile fuse, in which the fuse which has short-circuited may be easily identified with the naked eye by looking at the fuse itself, even without the use of an additional identification unit in addition to the fuse.

The present invention provides a method of manufacturing an automobile fuse which changes color upon short-circuiting, comprising mixing 96~99 wt % of colored plastic powder with 1~4 wt % of transparent irreversible thermochromic pigment powder thus preparing a material mixture for a fuse body; melting the material mixture using an injection molding machine so that the fuse body containing a thermochromic pigment component is molded at an injection temperature of 300~310° C. and an injection pressure of 1200~1600 kgf/cm$^2$ using an injection mold; drying the fuse body containing the thermochromic pigment component at 100~200° C. for 3~5 hr so that a moisture content of the fuse body is decreased to 0.1 wt % or less; inserting a fuse element comprising a pair of terminal members and a fuse member fixed therebetween into a pair of terminal insertion recesses and a fuse charging recess of the fuse body containing the thermochromic pigment component so as to be coupled thereto, thus assembling a fuse.

The color of the irreversible thermochromic pigment component may change to black when exposed to heat of 330~350° C.

In addition, the present invention provides an automobile fuse which changes color upon short-circuiting, comprising a fuse body comprising a colored plastic component and a transparent irreversible thermochromic pigment component; and a fuse element comprising a pair of terminal members and a fuse member fixed therebetween and inserted into a pair of terminal insertion recesses and a fuse charging recess of the fuse body so as to be fixedly coupled thereto, wherein a color of the thermochromic pigment component contained in the fuse body changes when exposed to heat of a flame generated upon short-circuiting of the fuse member.

The fuse body may comprise 96~99 wt % of the colored plastic component, and 1~4 wt % of the irreversible thermochromic pigment component.

The color of the irreversible thermochromic pigment component may change to black when exposed to heat of 330~350° C.

In addition, the present invention provides a method of manufacturing an automobile fuse which changes color upon short-circuiting, comprising mixing a colored oil coating, a transparent liquid irreversible thermochromic pigment, and a thinner, thus preparing a coating mixture; applying the coating mixture to a thickness of 8~40 μm on a fuse body so that the fuse body is coated with a color shift layer; drying the fuse body coated with the color shift layer at 60~65° C. for 10~30 min so that the thinner is removed and an oil film is formed on a surface of the color shift layer; inserting a fuse element comprising a pair of terminal members and a fuse member fixed therebetween into a pair of terminal insertion recesses and a fuse charging recess of the fuse body coated with the color shift layer so as to be coupled thereto, thus assembling a fuse.

The colored oil coating may be either oil ink or oil paint, and the coating mixture may comprise 37~47.5 wt % of a colored oil ink, 2.5~17 wt % of the transparent liquid irreversible thermochromic pigment, and 46~50 wt % of the thinner.

Also, the coating mixture may comprise 30~37.5 wt % of a colored oil paint, 2.5~15 wt % of the transparent liquid irreversible thermochromic pigment, and 55~60 wt % of the thinner.

The color of the irreversible thermochromic pigment component contained in the color shift layer may change to black when exposed to heat of 100~120° C.

In addition, the present invention provides an automobile fuse which changes color upon short-circuiting, comprising a fuse body, a surface of which is coated with a color shift layer containing a colored oil coating component and a transparent irreversible thermochromic pigment component; and a fuse element comprising a pair of terminal members and a fuse member fixed therebetween and inserted into a pair of terminal insertion recesses and a fuse charging recess of the fuse body so as to be fixedly coupled thereto, wherein a color of the thermochromic pigment component contained in the color shift layer changes when exposed to heat of a flame generated upon short-circuiting of the fuse member.

The color shift layer may comprise 74~95 wt % of a colored oil ink component, and 5~26 wt % of the transparent irreversible thermochromic pigment component.

Also, the color shift layer may comprise 60~75 wt % of a colored oil paint component, and 25~40 wt % of the transparent irreversible thermochromic pigment component.

The color of the irreversible thermochromic pigment component contained in the color shift layer may change to black when exposed to heat of at least 100~120° C.

The color shift layer may be applied to a thickness of 8~40 μm, and the color shift layer may be applied on an upper surface of the fuse body.

The color shift layer applied on the upper surface of the fuse body may be applied in a form of a letter which indicates a rated capacity of the fuse.

In addition, the present invention provides a method of manufacturing an automobile fuse which changes color upon short-circuiting, comprising mixing 4.0~95 wt. % of a colored printing ink and 5~60 wt % of a colored irreversible thermochromic pigment, thus preparing a printing mixture; applying the printing mixture on a surface of a substrate so that the substrate is printed with a color conversion printing layer; drying the substrate printed with the color conversion printing layer at 50~60° C. for 10~30 min; applying an adhesive layer on a surface of the substrate opposite the surface having the color conversion printing layer; attaching the substrate having the color conversion printing layer to a fuse body by means of the adhesive layer; inserting a fuse element comprising a pair of terminal members and a fuse member fixed therebetween into a pair of terminal insertion recesses and a fuse charging recess of the fuse body including the substrate having the color conversion printing layer so as to be coupled thereto, thus assembling a fuse.

The colored irreversible thermochromic pigment may become transparent when exposed to heat of 90~100° C.

In addition, the present invention provides an automobile fuse which changes color upon short-circuiting, comprising a fuse body comprising a color conversion label having a color conversion printing layer containing 40~95 wt % of a colored printing ink component and 5~60 wt % of a colored irreversible thermochromic pigment component, the color conversion label being attached to an outer surface of the fuse body by means of an adhesive layer; and a fuse element comprising a pair of terminal members and a fuse member fixed therebetween and inserted into a pair of terminal insertion recesses and a fuse charging recess of the fuse body so as to be fixedly coupled thereto, wherein the thermochromic pigment component contained in the color conversion printing layer becomes transparent when exposed to heat of a flame generated upon short-circuiting of the fuse member.

The irreversible thermochromic pigment component contained in the color conversion printing layer may become transparent when exposed to heat of at least 90~100° C.

In addition, the present invention provides a method of manufacturing an automobile fuse which changes color upon short-circuiting, comprising applying a colored printing ink on a substrate to print a colored printing ink layer; applying a colored irreversible thermochromic pigment on a surface of the colored printing ink layer thus forming a color conversion printing layer having a colored thermochromic pigment layer deposited thereon; drying the substrate printed with the color conversion printing layer at 50~60° C. for 10~30 min; applying an adhesive layer on a surface of the substrate opposite the surface having the color conversion printing layer; attaching the substrate having the color conversion printing layer to a fuse body by means of the adhesive layer; and inserting a fuse element comprising a pair of terminal members and a fuse member fixed therebetween into a pair of terminal insertion recesses and a fuse charging recess of the fuse body including the substrate having the color conversion printing layer so as to be coupled thereto, thus assembling a fuse.

The colored irreversible thermochromic pigment printed on the surface of the colored printing ink layer may be diluted in a thinner at a ratio of 50~80 wt % of the colored irreversible thermochromic pigment and 20~50 wt % of the thinner before being applied.

The colored thermochromic pigment layer may comprise a thermochromic pigment component which becomes transparent when exposed to heat of 90~100° C.

The substrate may be paper and the color conversion printing layer may be printed to a thickness of 30~40 μm.

In addition, the present invention provides an automobile fuse which changes color upon short-circuiting, comprising a fuse body comprising a color conversion label having a color conversion printing layer comprising a colored thermochromic pigment layer formed by applying a colored irreversible thermochromic pigment on a surface of a colored printing ink layer obtained by applying a colored printing ink on a substrate, the color conversion label being attached to an outer surface of the fuse body by means of an adhesive layer; and a fuse element comprising a pair of terminal members and a fuse member fixed therebetween and inserted into a pair of terminal insertion recesses and a fuse charging recess of the fuse body so as to be fixedly coupled thereto, wherein the thermochromic pigment component contained in the color conversion printing layer becomes transparent when exposed to heat of a flame generated upon short-circuiting of the fuse member.

The colored thermochromic pigment layer may comprise a thermochromic pigment component which becomes transparent when exposed to heat of 90~100° C.

The substrate may be paper and the color conversion printing layer may be printed to a thickness of 30~40 μm, and the color conversion label may be attached to an upper surface of the fuse body.

According to the present invention, an automobile fuse enables a short-circuited state to be easily identified with the naked eye because the color of a fuse body changes upon short-circuiting of a fuse member.

Also according to the present invention, among a great number of fuses of a fuse box mounted in an automobile, a fuse the color of which has changed to black can be detected, and thus the short-circuited fuse can be easily identified with the naked eye and can be very simply replaced.

Because the short-circuited fuse can be detected using a difference in color of a fuse member, it can be easily identified with the naked eye by looking at the fuse itself even without the use of an additional identification unit in addition to the fuse, thus reducing the manufacturing cost and remarkably increasing product reliability.

DESCRIPTION OF THE REFERENCE NUMERALS IN THE DRAWINGS

| | |
|---|---|
| 10: fuse body | 12: fuse charging groove |
| 15: upper surface | 16: color shift layer |
| 20: fuse element | 21, 21': terminal member |
| 22: fuse member | 30, 300: color conversion label |
| 31: substrate | 32, 320: color conversion printing layer |
| 33: adhesive layer | 311: colored printing ink layer |
| 312: colored thermochromic pigment layer | |

DETAILED DESCRIPTION OF THE INVENTION

Hereinafter, the present invention will be more clearly understood with reference to the appended drawings.

Figure 1:
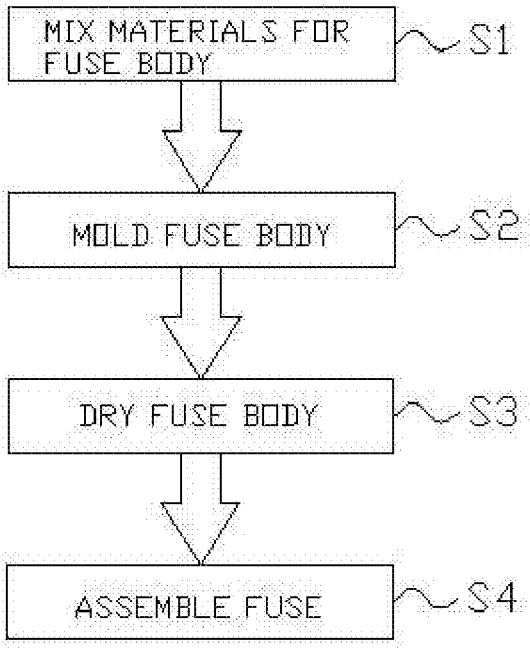
FIG. 1 is a flowchart illustrating a manufacturing process according to an embodiment of the present invention.
Figure 2:
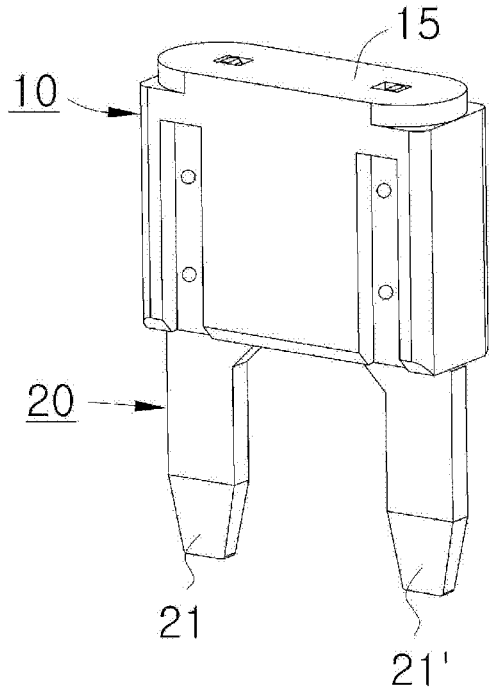
FIG. 2 is a total perspective view illustrating a fuse according to the present invention.
Figure 3:
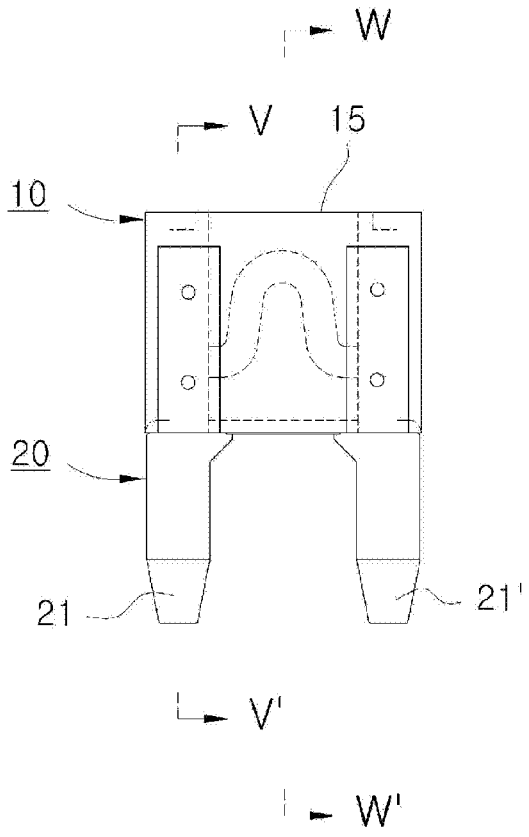
FIG. 3 is a front view illustrating the fuse according to the present invention.
Figure 4:
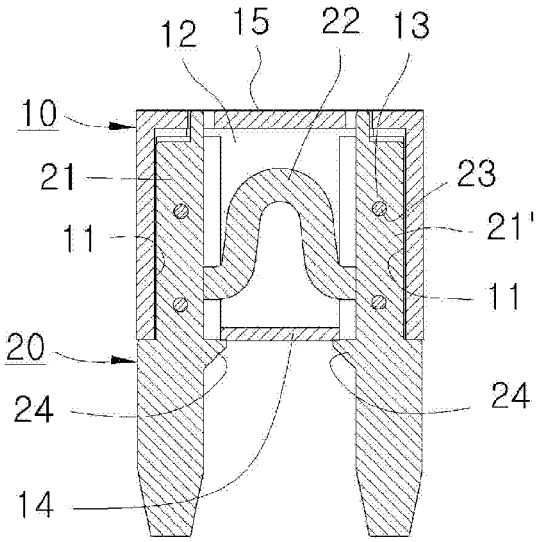
FIG. 4 is a front cross-sectional view illustrating the fuse according to the present invention.

FIG. 1 illustrates a process of manufacturing a fuse according to an embodiment of the present invention, and FIGS. 2, 3 and 4 are a perspective view, a front view and a front cross-sectional view of the fuse, respectively.

With reference to FIGS. 1 and 2, to manufacture the fuse of the present invention, the step of mixing materials for a fuse body (S1) is first performed.

The step of mixing the materials for a fuse body (S1) is carried out to form a fuse body 10, and the fuse body 10 is made of a plastic material.

To aid the understanding of the present invention, a thermochromic pigment includes a reversible thermochromic pigment whose color changes when heat is supplied whereas the color is restored back to its original color when heat is emitted, and an irreversible thermochromic pigment in which the color changed by heat is not restored back to its original color.

Also, there are exemplified a semi-transparent or transparent thermochromic pigment and a colored thermochromic pigment.

In the case of the semi-transparent or transparent thermochromic pigment, its color changes to black when exposed to heat, whereas the colored thermochromic pigment has physical properties wherein a thermochromic pigment having a predetermined color becomes transparent, and the temperatures at which the color changes may be differently set. Such thermochromic pigments are already known, and a detailed description of the physical properties which allow the color to change is omitted.

Thus, the thermochromic pigment used in an embodiment of the present invention is an irreversible thermochromic pigment whose color changes when exposed to heat but the changed color is not restored back to its original color and also which is transparent. Such a thermochromic pigment may be provided in a liquid phase or in the form of a powder or grain as big as a grain of rice.

In the step of mixing the materials for a fuse body (S1), 96~99 wt % of colored plastic powder and 1~4 wt % of transparent or semi-transparent irreversible thermochromic pigment powder are mixed using a mixer.

The plastic powder is preferably polycarbonate (PC), and acrylonitrile (ABS), polyethyleneterephthalate (PET), polystyrene (PS), polyvinyl chloride (PVC), polyester, nylon, polypropylene (PP), polyurethane (PU), phenol resin (PF), or urea resin (UF) may be used, if necessary.

Also, the colored plastic powder contains a coloring agent so that the fuse body 10 has a predetermined color, and thus the plastic powder itself has a color. The plastic powder containing the coloring agent is already known and a detailed description thereof is omitted.

The color of the plastic powder may vary in a range from a yellow color to a green color, and thus the color of the completed fuse body 10 is the same as that of the plastic powder.

To aid the understanding of the present invention, the fuse body 10 of an automobile fuse may be colored differently depending on the magnitude in amperes (A) to distinguish it.

Specifically, the color of the fuse body 10 is yellow at 5 A, brownish red at 7.5 A, red at 10 A, blue at 15 A, light yellow at 20 A, white at 25 A, and green at 30 A so as to distinguish it. In this way, the fuse body 10 may be imparted with a predetermined color using the colored plastic powder.

In the present invention, the irreversible thermochromic pigment powder in which the color which changed once is not restored back to its original color is mixed with the colored plastic powder thus producing a material mixture. As such, the thermochromic pigment powder and the plastic powder may be provided in the form of grain, but a powdered form may be used, if necessary.

The thermochromic pigment powder comprises an irreversible thermochromic pigment which is transparent or semi-transparent and changes to a black color when exposed to heat of 330~350° C.

Subsequently, the step of molding the fuse body (S2) is performed. In this procedure, the fuse body 10 is molded by means of an injection mold, and injection molding is carried out using an injection molding machine.

When the material mixture is fed into the inlet of the injection molding machine, it is melted by a heater and transferred into an injection mold by means of a screw thus molding the fuse body 10.

As such, because the fuse body 10 is molded into a relatively small size and is made thin, the fluidity of the molten material mixture is very low and thus an injection pressure of 1200~1600 kgf/cm$^2$ and an injection temperature of 300~310° C. are required.

Because the injection temperature is 300~310° C. and the irreversible thermochromic pigment component contained in the material mixture changes color only at 330~350° C., changes in color of the thermochromic pigment component do not occur in the step of molding the fuse body (S2).

When the molding has been completed, the molded fuse body 10 is removed from the injection mold.

Subsequently, the step of drying the fuse body (S3) is performed. In this procedure, the fuse body 10 is dried in an oven.

The fuse body molded in the step of molding the fuse body (S2) contains a considerable amount of moisture, and thus warpage, cracking or shrinkage may occur upon the subsequent evaporation of moisture.

In the step of drying the fuse body (S3), the fuse body 10 is dried at 100~200° C. for 3~5 hr, so that the moisture content of the fuse body 10 is decreased to 0.1 wt % or less.

Accordingly, because the fuse body 10 has a very small amount of moisture, warpage, cracking or shrinkage does not take place.

Subsequently, the step of assembling a fuse (S4) is performed. In this procedure, the fuse is assembled by inserting a fuse element 20 into the fuse body 10.

With reference to FIGS. 2 and 3, the fuse body 10 includes a pair of terminal insertion recesses 11 at both sides thereof and a fuse charging recess 12 between the pair of terminal insertion recesses 11, which communicate with each other.

The fuse element 20 includes a pair of terminal members 21, 21' and a fuse member 22 which is fixed between the pair of terminal members using welding.

Figure 5:
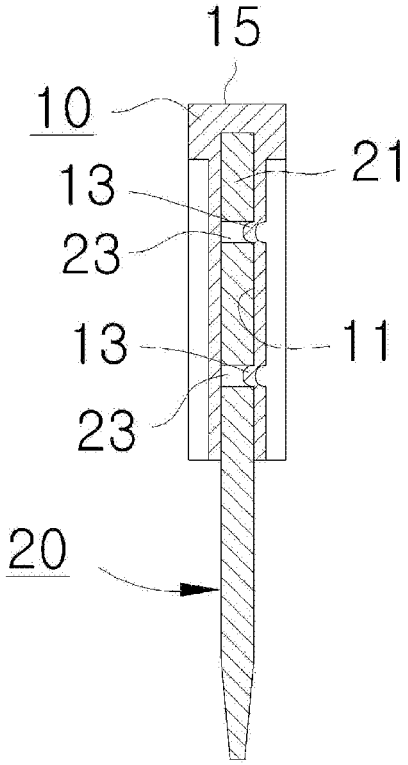
FIG. 5 is an enlarged cross-sectional view taken along the line V-V' of FIG. 3.

Thus when the fuse element 20 is inserted into the fuse body 10, the terminal members 21, 21' are tightly fitted into the terminal insertion recesses 11 as illustrated in FIG. 4, and the fuse member 22 is inserted into the fuse charging recess 12 as illustrated in FIG. 5.

A portion of the fuse body 10 into which the terminal members 21, 21' are inserted is pressed using a press pin of a hot press (not shown), whereby as illustrated in FIGS. 4 and 5, while the fuse body 10 is heated, protrusions 13 are formed and thus are inserted into locking holes 23 of the terminal members 21, 21'.

Because the protrusions 13 are locked into the locking holes 23, the fuse element 20 is assembled so as not to be removed from the fuse body 10.

Figure 6:
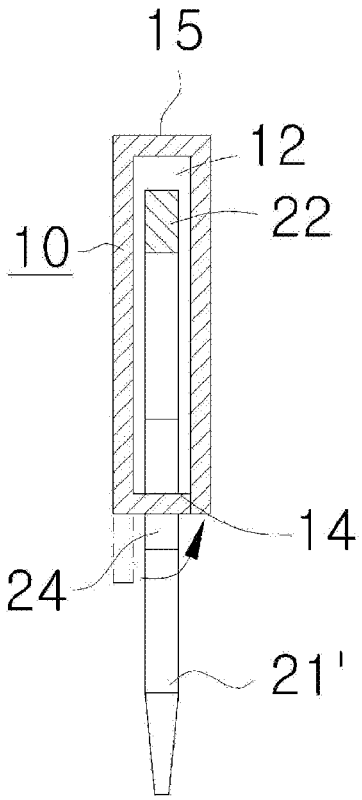
FIG. 6 is an enlarged cross-sectional view taken along the line W-W' of FIG. 3.

Furthermore, a cover 14 which is provided at one side of the lower end of the fuse body 10 is turned in the direction of an arrow as represented in FIG. 6, thereby closing the fuse charging recess 12.

As the cover 14 is locked by stoppers 24 protruding from the inner surface of the terminal members 21, 21', it does not open again to the exterior. Hence, introduction of impurities into the fuse charging recess 12 is blocked by the cover 14, so that the fuse member 22 is prevented from short-circuiting due to the impurities.

The above configuration of the fuse is already known, and the feature of the present invention is that the color of the fuse body 10 changes upon short-circuiting of the fuse member 22. Thus, assembling the fuse body 10 and the fuse element 20 may be carried out even in a fuse which has a configuration which is partially different or is different from the configuration illustrated in the present invention.

Therefore, the fuse completed by the manufacturing method according to the embodiment of the present invention is configured such that the fuse element 20, in which the fuse member 22 is fixed between the pair of terminal members 21, 21, is inserted into the pair of terminal insertion recesses 11 and into the fuse charging recess 12 of the fuse body 10 containing the colored plastic component and the semi-transparent irreversible thermochromic pigment component so as to be fixedly coupled thereto.

The color of the fuse body 10 of the completed fuse is shown as only a color (e.g. yellow) of the plastic component because the thermochromic pigment component is semi-transparent.

Also, a thermochromic pigment component having a predetermined color may be added, if necessary. In this case, when the colored plastic component has for example a yellow color, this color may be mixed with the color of the thermochromic pigment component. However, because only a small amount of this pigment component is present, the yellow color of the colored plastic component is not completely lost but a light or deep yellow color may be represented while the yellow color is maintained unchanged.

The fuse thus manufactured is installed so as to be connected in the fuse box of the engine room of an automobile.

Typically for example in the hot summer season, the temperature of the engine room of an automobile is about 60~65° C. when the automobile has been traveling for about 10 min and then stops, and is about 40~60° C. during travelling in a complicated city.

In terms of increasing the temperature of the engine room, even when the engine is operated and then stopped for about 1 hr or longer, the engine room does not become heated to a temperature equal to or above 70~80° C. in maximum.

Thus, because the color of the thermochromic pigment component contained in the fuse body 10 becomes different only at a temperature equal to or above 330~350° C., it does not change even when the thermochromic pigment is subjected to heat by the inner temperature of the engine room.

When a load or an electrical short occurs during the operation of the engine of an automobile, the fuse member 22 is short-circuited.

The fuse member 22 may be made of an alloy of soft solder and tin or copper, and typically melts at 280° C. or higher and is thus short-circuited.

When the fuse member 22 is short-circuited due to an electrical short, a flame is instantly generated. As such, the temperature of the flame is higher than 1000° C. The fuse member 22 itself has a temperature of about 330° C. as soon as it melts.

Because a flame exceeding 1000° C. is instantly generated in the fuse charging recess 12, the heat of the hot flame is transferred to the periphery of the fuse charging recess 12, so that the thermochromic pigment component contained in the fuse body 10 changes to black under high temperature heat.

The width of the fuse charging recess 12 into which the fuse member 22 is inserted is very narrow to the extent of about 1 mm, and the fuse member 22 by which the fuse charging recess 12 is defined is as thin as about 0.5~0.7 mm. All the heat of a hot flame instantly generated upon short-circuiting of the fuse member 22 is not transferred but heat of at least 500~600° C. is transferred to the fuse member 22, and this temperature exceeds 330~350° C. which is the color change temperature of the thermochromic pigment component, so that the color of the fuse member 10 changes to black.

Because the fuse member 10 contains the irreversible thermochromic pigment component, the changed black color thereof is not restored back to its original color and does not change.

Meanwhile, a great number of fuses mounted in an automobile are aligned in a single fuse box, and only the upper surface 15 of the fuse body 10 is visible.

Thus, the fuse the color of which has changed to black due to short-circuiting of the fuse member 22 may be detected. As such, the fuse whose color of the upper surface 15 of the fuse body 10 has changed to black may be detected.

Figure 7:
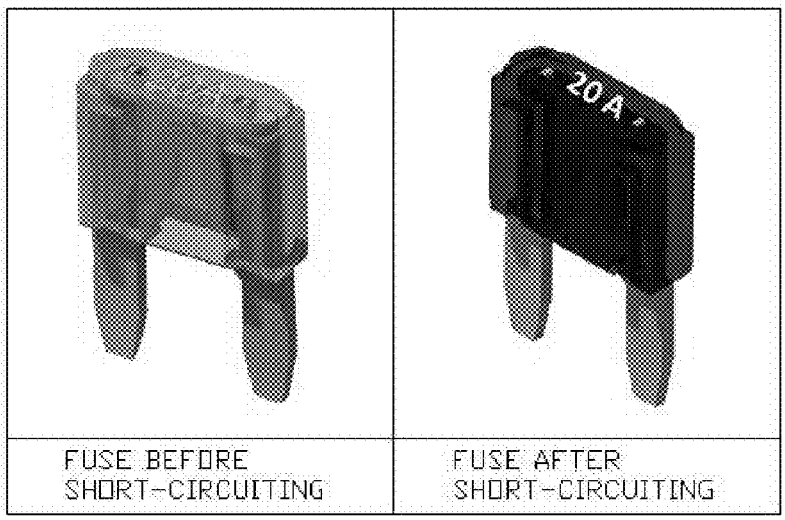
FIG. 7 is of views illustrating the fuse according to an embodiment of the present invention before and after short-circuiting.

FIG. 7 illustrates the fuse before and after changes in color, in which the upper surface 15 of the fuse before the change is shown as the color of the colored plastic whereas the upper surface 15 of the fuse in which the fuse member 22 has short-circuited is seen to be a black color.

It is only required to detect the fuse the color of which has changed to black among the many fuses in the fuse box of the automobile and thus such a fuse may be easily identified with the naked eye, so that the short-circuited fuse may be more simply and easily replaced.

Figure 8:
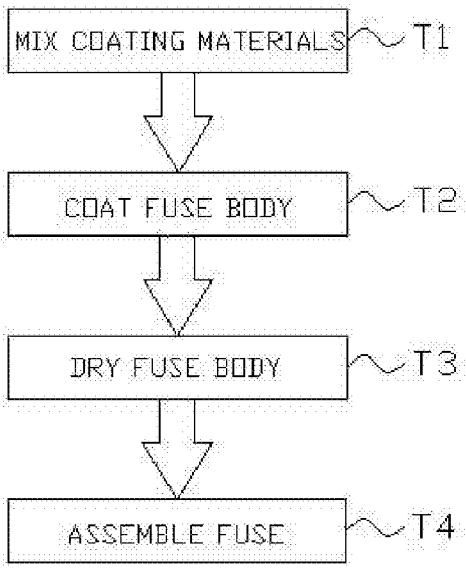
FIG. 8 is a flowchart illustrating a manufacturing process according to another embodiment of the present invention.

On the other hand, FIG. 8 illustrates a manufacturing process according to another embodiment of the present invention.

With reference to FIG. 8, the step of mixing coating materials (T1) is first performed.

In the step of mixing coating materials (T1), a colored oil coating, a transparent liquid irreversible thermochromic pigment (which is called a liquid thermochromic pigment) and a thinner which increases fluidity are mixed thus obtaining a coating mixture.

The colored oil coating may include oil ink or oil paint, and in the coating mixture of the present invention these two oil ink and oil paint may be used alone or in combination.

Specifically, the colored oil ink is mixed with the transparent liquid irreversible thermochromic pigment (which is also referred to as a liquid thermochromic pigment), or the colored oil paint is mixed with the transparent liquid irreversible thermochromic pigment. In either case, a thinner may be further added.

The colored oil ink or oil paint used in the present invention includes an additive such as a curing agent, etc., and is thus known to be reliably attached to a target such as the fuse body 10 and a detailed description thereof is omitted.

The transparent liquid irreversible thermochromic pigment changes color when exposed to heat of at least 100~120° C. and is in a transparent state, and the thinner is also transparent. Thus, when these components are mixed with the oil ink or the oil paint to prepare the coating mixture, the coating mixture may show the color of the colored oil ink or oil paint.

For example, when the color of the oil ink or oil paint is white, the coating mixture has a white color, and when the color of the oil ink or oil paint is light green, the color of the coating mixture is also green.

Thus, the coating mixture has the color of the fuse body 10 varying depending on the magnitude in amperes of the fuse, and the oil ink or oil paint colored with the same color as that of the fuse body 10 which is to be coated may be used.

In the case where the coating mixture is applied in the form of a letter or a numeral represented on the fuse body 10, a color different from the color of the fuse body 10 should be applied. In this case, oil ink or oil paint having a color different from that of the fuse body 10 is mixed with the thermochromic pigment and the thinner thus preparing a coating mixture.

Thus, when the colored oil ink, the transparent liquid irreversible thermochromic pigment and the thinner are mixed together, 37~47.5 wt % of the colored oil ink, 2.5~17 wt % of the transparent liquid irreversible thermochromic pigment, and 46~50 wt % of the thinner are mixed using a mixer.

Meanwhile, when the colored oil paint, the transparent liquid irreversible thermochromic pigment and the thinner are mixed together, 30~37.5 wt % of the colored oil paint, 2.5~15 wt % of the transparent liquid irreversible thermochromic pigment, and 55~60 wt % of the thinner are mixed using a mixer.

Among the components of the coating mixture, the thinner functions to make fluidity of the coating mixture good and is completely evaporated and dried in the subsequent step of drying the fuse body (T3).

Thus in the present invention two types of coating mixtures may be obtained in the step of mixing coating materials (T1), and thus these coating mixtures are respectively subjected to subsequent processes, wherein the subsequent processes are the same as each other and thus are not described repetitively but only once.

The coating mixture comprising the colored oil ink and the coating mixture comprising the colored oil paint are respectively applied in the step of coating the fuse body (T2). This procedure is performed by coating the upper surface 15 of the fuse body 10 with the coating mixture.

Figure 9:
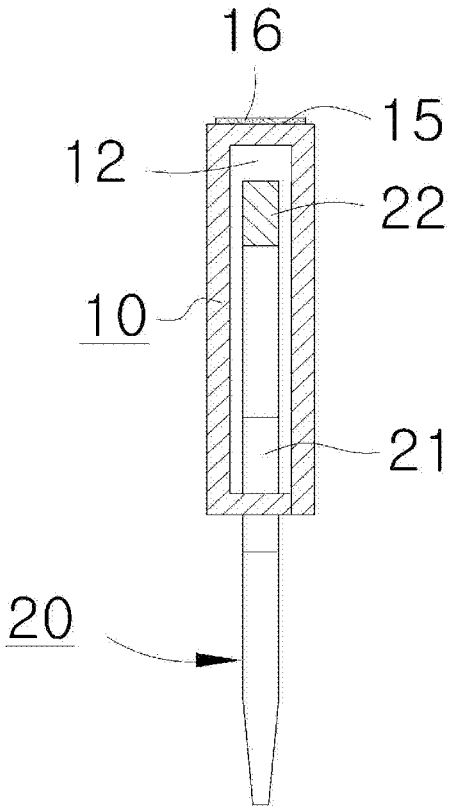
FIG. 9 is a cross-sectional view illustrating one side of a fuse according to another embodiment of the present invention.

In the step of coating the fuse body (T2), the coating mixture may be applied by spraying it onto the upper surface 15 of the fuse body 10 using a spray type coater (not shown), or by painting the upper surface 15 of the fuse body 10 with a color shift layer 16 using a printing type coater (not shown) as illustrated in FIG. 9. However, the front surface, rear surface or both side surfaces of the fuse body 10 may be coated, if necessary.

The color shift layer 15 applied on the fuse body 10 is applied on the upper surface 15 of the fuse body 10 positioned on the fuse charging recess 12, and is preferably provided in the form of a figure or a letter.

For example, a round circular mark, or a figure mark "X" which indicates a state of a fuse having short-circuited may be provided, or a ampere indication letter (e.g. 20 A) may be applied on the fuse body 10.

The coating thickness of the color shift layer 16 may be 8~40 μm, which does not impede the use of the fuse at all.

Subsequently, the step of drying the fuse body (T3) is conducted.

In this procedure, the color shift layer 16 is dried, and specifically the fuse body 10 coated with the color shift layer 16 is dried in an oven (not shown) at 60~65° C. for 10~30 min.

Because the irreversible thermochromic pigment of the present invention changes color only when exposed to heat of at least 100~120° C., the color of the color shift layer 16 does not change in the step (T3) of drying the fuse body 10 coated with the color shift layer 16 at 60~65° C.

Thus, in the course of drying the color shift layer 16, almost all of the thinner component may evaporate, and only the coating mixture comprising the colored oil ink or oil paint and the transparent liquid irreversible thermochromic pigment is left behind in a solid phase, so that an oil film is formed on the surface of the color shift layer. This oil film blocks the permeation of impurities during the use of the fuse and thus functions to prevent the contamination of the color shift layer 16.

After the drying process, the color shift layer 16 is shown only as having the color of the colored oil ink or oil paint because the contained thermochromic pigment component is transparent.

For example, if the colored oil ink or oil paint is a yellow color, the above layer is shown as a yellow color, and if it is a white color, the above layer is shown as a white color.

Subsequently, the step of assembling the fuse (T4) is conducted.

The step of assembling the fuse (T4) allows the fuse element 20 comprising the pair of terminal members 21, 21' and the fuse member fixed therebetween to be coupled to the pair of terminal insertion recesses 11 and the fuse charging recess 12 of the fuse body 10.

This step of assembling the fuse (T4) is the same as the step of assembling the fuse (S4) as mentioned above, and a detailed description thereof is omitted herein.

Accordingly, the completed fuse is configured such that the fuse member 22 is inserted into the fuse charging recess 12 and the upper surface 15 of the fuse body 10 is coated with the color shift layer 16, as illustrated in FIG. 9.

Because the color shift layer 16 is in a state of the thinner component having evaporated in the step of drying the fuse body (T3), only the coating mixture comprising the colored oil ink or oil paint and the transparent irreversible thermochromic pigment is left behind in the solid phase and thus attached.

When the colored oil ink and the transparent liquid irreversible thermochromic pigment are mixed to prepare the coating mixture in the step of mixing coating materials (T1), the color shift layer 16 comprises 74~95 wt % of the colored oil ink and 5~26 wt % of the transparent irreversible thermochromic pigment.

On the other hand when the colored oil paint and the transparent liquid irreversible thermochromic pigment are mixed, the color shift layer 16 comprises 60~75 wt % of the colored oil paint and 25~40 wt % of the transparent irreversible thermochromic pigment.

The fuse thus manufactured is installed so as to be connected in the fuse box of the engine room of an automobile and the engine room of the automobile is not heated to a temperature equal to or above 70~80° C. in maximum as mentioned above. Because the color of the thermochromic pigment contained in the color shift layer 16 changes only at a temperature of at least 100~120° C., the color of the thermochromic pigment does not change at all even under heat based on the inner temperature of the engine room.

When a load or an electrical short occurs during the operation of an automobile engine and short-circuits the fuse member 22, the heat of a hot flame exceeding 1000° C. may be generated and transferred to the periphery of the fuse charging recess 12, so that the color of the thermochromic pigment component contained in the color shift layer 16 changes to black because of the high temperature heat.

Specifically all the heat of the hot flame instantly generated upon short-circuiting of the fuse member 22 is not transferred but heat of at least 500~600° C. is transferred to the color shift layer 16, which is higher than 100~120° C. which is the color change temperature of the thermochromic pigment component, so that the color of the color shift layer 16 changes to black.

Because the color shift layer 16 contains the irreversible thermochromic pigment component, the black color thus changed is not restored back to its original color and does not change.

Meanwhile, a great number of fuses mounted in the automobile are aligned in a single fuse box and thus only the upper surface 15 of the fuse body 10 is visible. The color shift layer 16 is applied on such an upper surface 15, and thereby the changed color may be easily identified with the naked eye.

When the fuse member 22 is short-circuited, the fuse the color of which has changed to black is detected. Specifically, the fuse in which the color of the color shift layer 16 on the upper surface 15 of the fuse body 10 has changed to black is detected.

Figure 10:
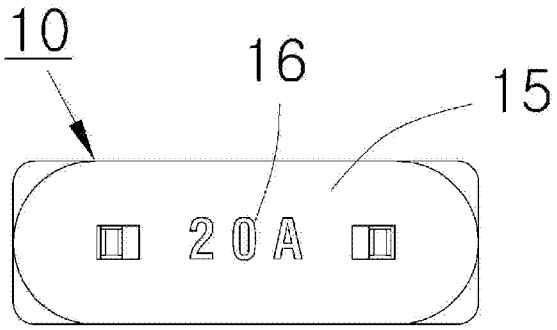
FIG. 10 is a top plan view illustrating the fuse according to another embodiment of the present invention.

As illustrated in FIG. 10, the color shift layer 16 may be applied in the form of a character (or a letter). In this case, every fuse is represented by a rated capacity in the unit of ampere, and the rated capacity (e.g. 20 A) is displayed by using the color shift layer 16.

When the color shift layer 16 which indicates the rated capacity is shown as a white color, the color of the color shift layer 16 which indicates the rated capacity in the form of a letter changes to black because of the heat of a flame instantaneously generated upon short-circuiting of the fuse member 22.

Figure 11:
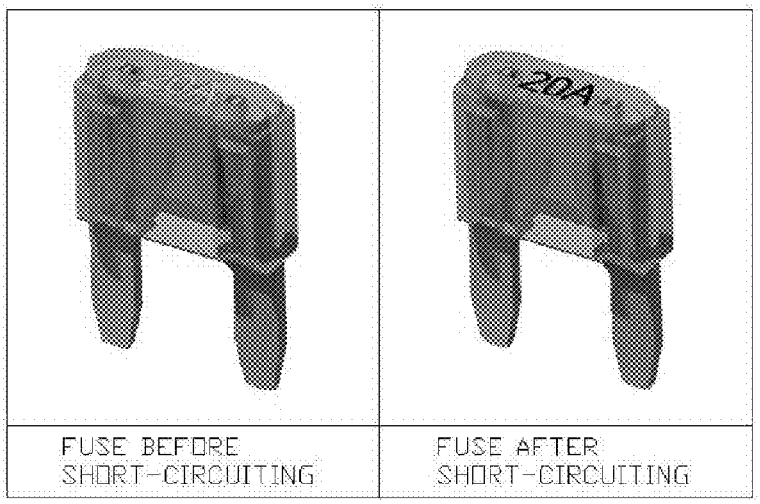
FIG. 11 is of views illustrating the fuse according to another embodiment of the present invention before and after short-circuiting.

FIG. 11 illustrates the fuse before and after changes in color. Before the change in color, the color of the color shift layer 16 which indicates the rated capacity, which is applied on the upper surface 15 of the fuse, is white, whereas the color of the color shift layer 16 which indicates the rated capacity on the upper surface 15 of the fuse in which the fuse member 22 has short-circuited is changed to black.

Among many fuses in the fuse box mounted in the automobile, the fuse in which the rated capacity indication color has changed to black is detected, which may be easily identified with the naked eye. Thereby, the short-circuited fuse may be very simply and easily replaced.

Figure 12:
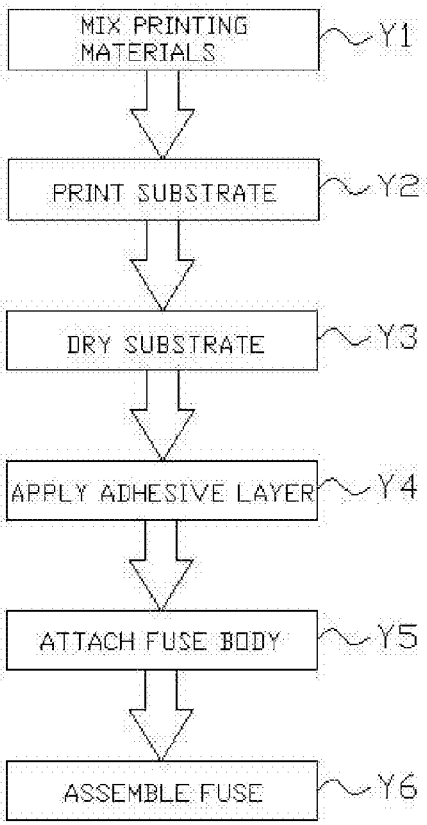
FIG. 12 is a flowchart illustrating a manufacturing process according to a further embodiment of the present invention.

FIG. 12 illustrates a manufacturing process according to a further embodiment of the present invention, which will be described in detail below.

With reference to FIG. 12, the step of mixing printing materials (Y1) is first conducted.

The step of mixing printing materials (Y1) is performed by mixing 40~95 wt % of colored printing ink with 5~60 wt % of a colored irreversible thermochromic pigment to prepare a printing mixture.

The colored printing ink is normally used in a printing process, which is already known, and a detailed description thereof is omitted.

The colored irreversible thermochromic pigment has a predetermined color (e.g. yellow, red, etc.), and thus is mixed with the colored printing ink, so that the color of the printing mixture is a mixed color of the color of the thermochromic pigment and the color of the printing ink.

The final color to be printed is determined in advance, and the colors of printing ink and thermochromic pigment are selected that will make a printing mixture that makes the final color, and these are then mixed.

As the colored irreversible thermochromic pigment, a thermochromic pigment which changes to transparency under heat is used, in which the temperature at which the above pigment becomes transparent is at least 90~100° C.

Subsequently, the step of printing a substrate using the colored printing mixture (Y2) is conducted.

Figure 13:
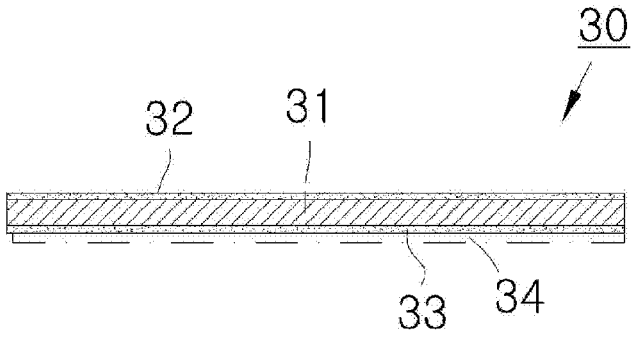
FIG. 13 is a longitudinal cross-sectional view illustrating a color conversion label according to the present invention.

The step of printing the substrate (Y2) is performed in such a manner that the surface of the substrate 31 is printed with a color conversion printing layer 32 as illustrated in FIG. 13 using a printer (not shown). The coating thickness of the color conversion printing layer 32 is preferably 30~40 μm. The printing process using a printer is already known and a detailed description thereof is omitted.

Also, before the color conversion printing layer 32 is printed, an acron primer (not shown) may be applied as an undercoating on the surface of the substrate 31, if necessary. This procedure may be carried out differently depending on the kind of substrate 31.

The substrate 31 may be formed of any material so long as it may sufficiently endure heat generated in the engine room of an automobile and may be printed. Preferably useful is paper.

Subsequently, the step of drying the substrate (Y3) is conducted by drying the substrate 31 printed with the color conversion printing layer 32 in an oven.

In the step of drying the substrate (Y3), drying is carried out at 50~60° C. for 10~30 min. Because the thermochromic pigment used changes its color at a temperature of at least 90~100° C., it does not change at all in the drying procedure at 50~60° C. but is dried well.

Subsequently, the step of applying an adhesive layer (Y4) is conducted.

In the step of applying the adhesive layer (Y4), the other surface of the substrate 31 is coated with an adhesive layer 33, and the adhesive layer 33 and the application technique thereof are already known, and a detailed description thereof is omitted.

After the adhesive layer 33 is applied, a release liner 34 is attached thereto in order to prevent the substrate from being attached to another object during handling, and the release liner 34 may be stripped upon use.

Thus, the procedures up to the step of applying the adhesive layer (Y4) are carried out, thus obtaining a color conversion label 30.

Subsequently, the step of attaching a fuse body (Y5) is conducted. In this procedure, the color conversion label 30 is attached to the fuse body 10, as illustrated in FIG. 14.

Figure 14:
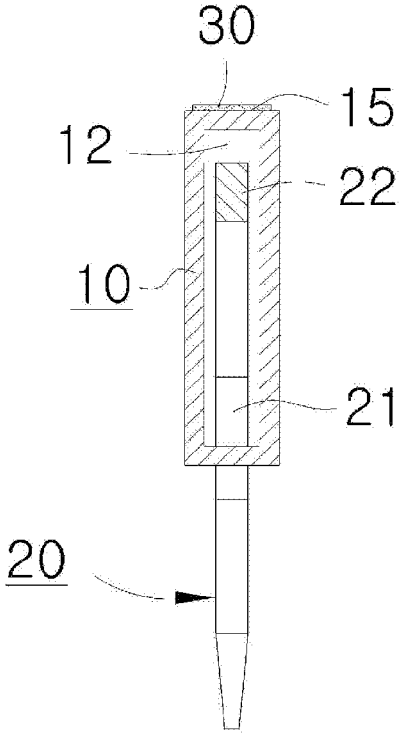
FIG. 14 is a cross-sectional view illustrating one side of a fuse according to a further embodiment of the present invention.

The color conversion label 30 is preferably attached to the upper surface 15 of the fuse body 10 as illustrated in FIG. 14.

The color of the color conversion label 30 is a mixed color of the color of the thermochromic pigment and the color of the printing ink.

The color conversion printing layer 31 of the color conversion label 30 comprises 40~95 wt % of a colored printing ink component and 5~60 wt % of a colored irreversible thermochromic pigment component.

Figure 15:
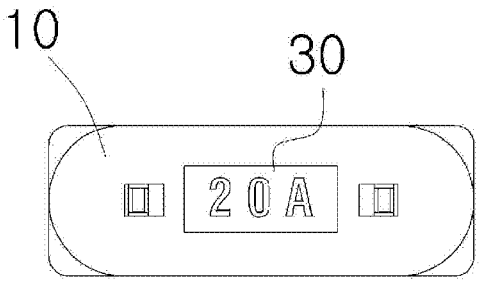
FIG. 15 is a top plan view illustrating the fuse according to a further embodiment of the present invention.

As illustrated in FIG. 15, a print represented by a rated capacity (e.g. 20 A) of a fuse is preferably attached to the color conversion label 30, and a rated capacity indication letter is printed using typical printing ink.

Subsequently, the step of assembling a fuse (Y6) is performed.

The step of assembling the fuse Y6 is performed in such a manner that the fuse body 10 having the color conversion label 30 attached thereto is coupled with the fuse element 20.

The step of assembling the fuse (Y6) is the same as the step of assembling the fuse (S4, T4) according to the aforementioned embodiments, and a detailed description thereof is omitted.

The fuse thus manufactured is installed to be connected in the fuse box of the engine room of an automobile, and the engine room is not heated to a temperature equal to or above 70~80° C. in maximum as mentioned above. Thus, because the thermochromic pigment which is contained in the color conversion printing layer 32 of the color conversion label 30 changes its color only at a temperature of at least 90~100° C., it is not changed by the inner temperature of the engine room.

When the fuse member 22 is short-circuited due to a load or an electrical short during the operation of the engine of an automobile, the heat of a hot flame exceeding 1000° C. is generated and transferred to the periphery of the fuse charging recess 12, so that the colored thermochromic pigment component contained in the color conversion printing layer 32 is changed by the high temperature heat.

The colored thermochromic pigment component is dissolved and changes to transparency depending on the properties of materials thereof, and thereby the color conversion label 30 is shown as the original color of the colored printing ink. Thus, the changed color of the color conversion label 30 is shown upon short-circuiting of the fuse member 22.

The thermochromic pigment component which has changed to transparency is irreversible and its original color is not restored.

Figure 16:
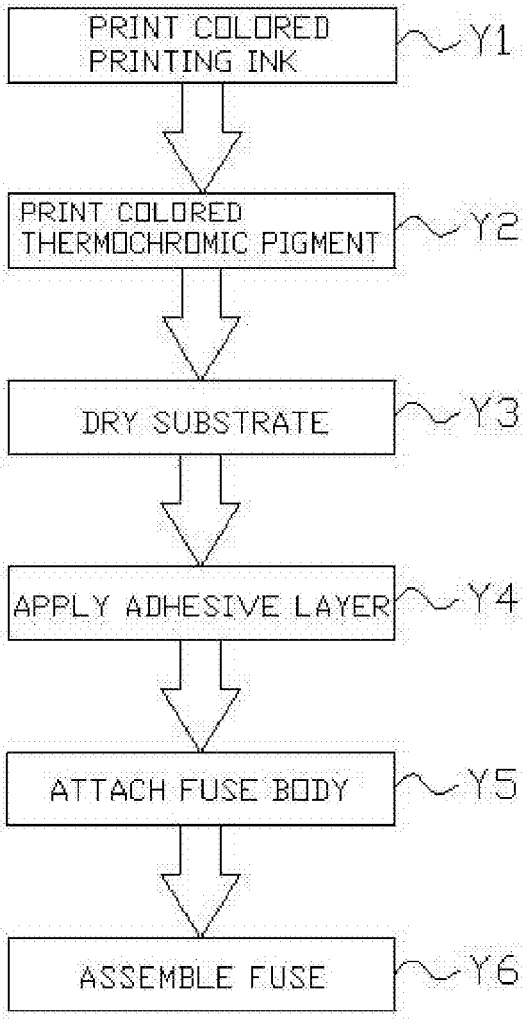
FIG. 16 is a flowchart illustrating a manufacturing process according to still a further embodiment of the present invention which is a modification of FIG. 12.

FIG. 16 illustrates a manufacturing process according to still a further embodiment of the present invention.

In the present invention, the step of printing colored printing ink (Y10) is first performed.

The step of printing the colored printing ink (Y10) is carried out by printing a substrate 31 with the colored printing ink.

Figure 17:
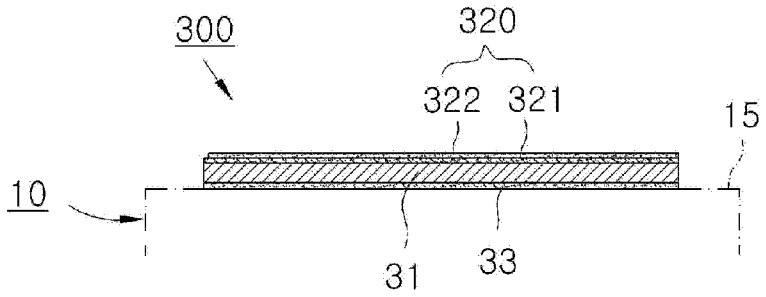
FIG. 17 is a longitudinal cross-sectional view illustrating a color conversion label formed in the embodiment of FIG. 16.

As illustrated in FIG. 17, a colored printing ink layer 321 is printed on the surface of the substrate 31 using a typical printing process, and the printing ink is already known, and thus drying progresses rapidly.

Subsequently, the step of printing a colored thermochromic pigment (Y20) is performed, and the colored irreversible thermochromic pigment is applied on the colored printing ink layer 321.

To make the thermochromic pigment be well printed in the step of printing the colored thermochromic pigment (Y20), the thermochromic pigment is diluted with a thinner before being printed.

The dilution ratio is as follows: 50~80 wt % of the colored irreversible thermochromic pigment and 20~50 wt % of the thinner, thus obtaining good fluidity.

As the colored irreversible thermochromic pigment, an irreversible thermochromic pigment which has a predetermined color at ordinary times and then changes to transparency when exposed to heat of 90~100° C. is used.

The thinner is mostly evaporated and dried in the step of drying the substrate (Y3), and only the colored thermochromic pigment layer 322 is left behind.

After completion of the step of printing the colored thermochromic pigment (Y20), the surface of the substrate 31 has a color conversion printing layer 320 comprising the colored printing ink layer 321 and the colored thermochromic pigment layer 322 deposited thereon. The coating thickness of the color conversion printing layer 320 is 30~40 μm.

Subsequently, the step of drying the substrate (Y3), the step of applying an adhesive layer (Y4), the step of attaching a fuse body (Y5) and the step of assembling a fuse (Y6) are performed, and are the same as the steps as mentioned above.

Thus after completion of the above procedures, the color conversion label 300 having the color conversion printing layer 320 in which the colored thermochromic pigment layer 322 is deposited on the colored printing ink layer 321 on the surface of the substrate 31 is attached to the upper surface 15 of the fuse body 10 by means of the adhesive layer 33, thereby obtaining a fuse.

The fuse is installed to be connected in the fuse box of the engine room of an automobile so that the color of the colored thermochromic pigment layer 322 is ordinarily visible.

Thus when the fuse member 22 is short-circuited due to a load or an electrical short during the operation of the engine, the heat of a hot flame exceeding 1000° C. is generated and transferred to the periphery of the fuse charging recess 12, whereby the colored thermochromic pigment component of the color conversion printing layer 320 is changed because of the high temperature heat.

The colored thermochromic pigment layer 322 is changed by being dissolved and rendered transparent depending on the properties of the materials thereof, whereby the color of the colored printing ink layer 321 is externally shown.

Because the color conversion label 300 is shown as the color of the colored printing ink layer 321, the changed color of the color conversion label 300 is shown upon short-circuiting of the fuse member 22.

The colored thermochromic pigment layer 322 which has changed to transparency is irreversible and its original color is not restored.

Figure 18:
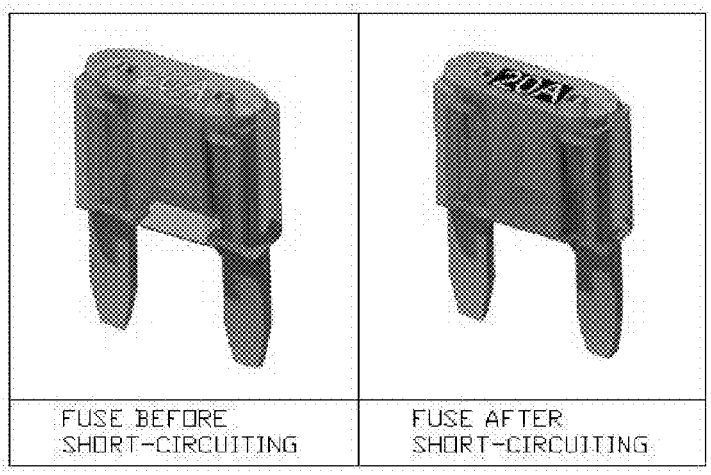
FIG. 18 is of views illustrating a fuse according to still a further embodiment of the present invention before and after short-circuiting.

FIG. 18 illustrates the fuse before and after changes in color, in which the color of the color conversion label 30, 300 attached to the upper surface 15 of the fuse is yellow before the change, but changes to black after the fuse member 22 has short-circuited.

Among the many fuses in the fuse box mounted in the automobile, the fuse in which the rated capacity indication color has changed to black is detected, which may be easily identified with the naked eye and thus replacing the short-circuited fuse may be very simple.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of manufacturing an automobile fuse which changes color upon short-circuiting, comprising:

mixing 96~99 wt % of colored plastic powder with 1~4 wt % of transparent irreversible thermochromic pigment powder thus preparing a material mixture for a fuse body;

melting the material mixture using an injection molding machine so that the fuse body containing a thermochromic pigment component is molded at an injection temperature of 300~310° C. and an injection pressure of 1200~1600 kg f/cm$^2$ using an injection mold;

drying the fuse body containing the thermochromic pigment component at 100~200° C. for 3~5 hr so that a moisture content of the fuse body is decreased to 0.1 wt % or less;

inserting a fuse element comprising a pair of terminal members and a fuse member fixed therebetween into a pair of terminal insertion recesses and a fuse charging recess of the fuse body containing the thermochromic pigment component so as to be coupled thereto, thus assembling a fuse.

2. The method of claim 1, wherein a color of the irreversible thermochromic pigment component changes to black when exposed to heat of 330~350° C.

* * * * *